United States Patent [19]

Matsuura

[11] 3,932,185

[45] Jan. 13, 1976

[54] MULTI-LAYER PHOTOSENSITIVE MATERIAL FOR COLOR PHOTOGRAPHY

[75] Inventor: Katsumi Matsuura, Hino, Japan

[73] Assignee: Konishiroku Photo Industry Co., Inc., Tokyo, Japan

[22] Filed: Aug. 12, 1974

[21] Appl. No.: 496,641

[30] Foreign Application Priority Data

Aug. 16, 1973 Japan ..... 48-91265

[52] U.S. Cl. ..... 96/74; 96/76 R; 96/109

[51] Int. Cl.[2] ..... G03C 1/76

[58] Field of Search ..... 96/95, 66.3, 74, 68, 22, 96/100, 76 R

[56] References Cited

UNITED STATES PATENTS

| | | | |
|---|---|---|---|
| 3,620,745 | 11/1971 | Seymour | 96/68 |
| 3,632,345 | 1/1972 | Marx et al. | 96/95 |

*Primary Examiner*—David Klein

*Assistant Examiner*—Alfonso T. Suro Pico

*Attorney, Agent, or Firm*—Linda G. Bierman; Jordan B. Bierman; Kenneth J. Stempler

[57] ABSTRACT

A multi-layer photosensitive material for color photography comprising a support and coated thereon, a first color image-forming layer unit composed of a red-sensitive silver halide emulsion, a second color image-forming layer unit composed of a green-sensitive silver halide emulsion and a third color image-forming layer unit composed of a blur-sensitive silver halide emulsion; characterized in that at least one of said color image-forming layer units has a composite layer structure including a lower layer and an upper layer which are positioned in sequence from the support, said upper layer has a higher sensitivity and a lower maximum developed color density than said lower layer, and at least one of said upper layer and lower layer contains a mercaptan type development inhibitor-releasing compound capable of reacting with an oxidation product of a primary aromatic amine to form a substantially colorless compound.

9 Claims, No Drawings

MULTI-LAYER PHOTOSENSITIVE MATERIAL FOR COLOR PHOTOGRAPHY

This application claims the priority of Japanese application No. 91265/73, filed Aug. 16, 1973.

This invention relates to a multi-layer photosensitive material for color photography. More particularly, the invention relates to a multi-layer photosensitive material for color photography which is improved in such photographic characteristics as fog, sensitivity, gradient, granularity, sharpness and color reproducibility.

It is known that in order to improve the sensitivity and granularity of a multi-layer photosensitive material for color photography, one color image-forming unit layer sensitive to one specific spectral region is divided into two layers, i.e., upper and lower layers. More specifically, in an ordinary multi-layer film for color photography comprising a support and, laminated thereon, as the main three constituent layers, a red-sensitive silver halide emulsion layer capable of forming a cyan dye image, a green-sensitive silver halide emulsion layer capable of forming a magenta dye image and a blue-sensitive silver halide emulsion layer capable of forming a yellow dye image, in order to improve the sensitivity and granularity of such photographic film, at least one of the foregoing three color image-forming layers unit is divided into two layers, i.e., upper and lower layers, and a large-particle, high-sensitivity silver halide emulsion is used for the upper layer and a small-particle, low-sensitivity silver halide emulsion is used for the lower layer, whereby coarsening of the mottle such as caused in the case of a single layer structure composed of a silver emulsion including large and small particles can be prevented and the granularity can be therefore improved. Further, if the amount of the coupler per mole of the silver halide is made smaller in the upper layer than in the lower layer, the maximum density portion of the upper layer can be formed of piled and blurred dye clouds, whereby the granularity of the medium or high density region can be improved.

However, such known methods dividing color image-forming layers into upper and lower layers are still insufficient and improvement of the granularity cannot be attained by these known methods. More specifically, the granularity is still insufficient in the range from the toe of the characteristic curve to the middle region. One cause is a nonpiled large dye cloud formed in the medium density region, and another cause is roughness in the granularity considered to be due to the fact that a silver halide of a relatively broad particle size distribution is employed as the lower layer emulsion in order to broaden the latitude. Further, since it is necessary to impart a sufficient sensitivity to a high sensitivity emulsion for the upper layer and hence, a chemically sensitized silver halide emulsion having a large particle size is generally used at a high silver content, there is brought about a defect that fogs are readily caused to occur.

Moreover, since the silver density is increased in the upper layer, the contrast frequently becomes high in the upper layer portion, and therefore, in a composite layer structure of upper and lower layers, defective gradient appears in the range of from the toe to the middle in the sensitometric characteristic curve.

Still further, in such composite layer structure, since a color image consisting of blurred dye clouds is formed in the upper layer, degradation of the sharpness cannot be avoided.

It is therefore a primary object of this invention to overcome the foregoing defects involved in the conventional composite layer structure and to provide a multi-layer photosensitive material including a color image unit which has the composite layer structure, which is highly improved in photographic characteristics such as sensitivity, gradient, granularity, sharpness, fog property and color reproducibility.

We have now found that the foregoing object can be attained by a multi-layer photosensitive material for color photography comprising a support and, formed thereon, a color image-forming layer unit including a red-sensitive silver halide emulsion, another color image-forming layer unit including a green-sensitive silver halide emusion and still another color image-forming layer including a blue-sensitive silver halide emulsion, optionally in combination with an undercoat layer, an intermediate layer, a protective layer and the like, wherein at least one of said color image-forming layers is composed of an upper layer and a lower layer disposed in a position closer to the support, the silver halide emulsion of the upper layer being sensitive to substantially the same spectral region as that of the lower layer ( a non-photosensitive layer may be disposed between the upper and lower layers according to need ), a higher sensitivity and a smaller maximum developed color density are retained in the upper layer as compared with the lower layer, and wherein a mercaptan type development inhibitor-releasing compound capable of reacting with an oxidation product of a color developing agent to form a substantially colorless compound is contained in at least one of said upper and lower layers.

According to this invention, there is provided a multilayer photosensitive material for color photography which is excellent in such photographic characteristics as fog, sensitivity, granularity, sharpness and color reproducibility. The mercaptan type development inhibitor-releasing compound to be used in this invention reacts under normal development conditions with an oxidation product of a color developing agent to form a colorless compound and to release a mercaptan type development inhibitor depending on the density of the image. The so released mercaptan type development inhibitor inhibits the development depending on the image density in the source layer from which it has been released and exhibits so-called intra-image effects of reducing the gamma value and improving the granularity and the sharpness of the image. In case the mercaptan type development inhibitor is diffusible, it inhibits the development in other layers depending on the density of the image of the source layer from which it has been released, and therefore, it is expected that the development inhibitor will exhibit so-called inter-image effects; namely, improvement of the color reproducibility in the multilayer photosensitive material for color photography. If this mercaptan type development inhibitor-releasing compound is used for the multi-layer photosensitive material of this invention according to the two-layer method, many other advantages are attained. For example, when the mercaptan type development inhibitor-releasing compound is incorporated into the upper layer having a higher sensitivity and a lower maximum developed color density than those of the lower layer, the development-inhibiting effect is attained by the mercaptan type development inhibitor in proportion to the image density of the upper layer, and further, in the multi-layer structure of upper and lower layers, the granularity is improved in the range of from the toe to the middle of the sensitometric characteristic curve. Further, the development-inhibiting effect attained in proportion to the image density results in reduction of the contrast in the upper layer and hence, the disorder of the gradient caused by the superposition of the gradients of the upper and lower layers in the range of from the toe to the middle of the sensitometric characteristic curve, (which is frequently observed in conventional multi-layer photosensitive materials), can be greatly improved. Still further, by reduction of the contrast in the upper layer, it is possible to form a two-layer structure in which a larger amount of the silver halide is incorporated in the upper layer, and hence, the sensitivity can be greatly heightened. In addition, since the mercaptan type development inhibitor-releasing compound is incorporated in the upper layer, the upper layer emulsion of a higher sensitivity where fog is readily caused can be greatly stabilized and occurrence of fog can be greatly reduced. More specifically, by the development-inhibiting activity of the mercaptan type development inhibitor released at the development step, coarsening of fog particles can be prevented. Further, when the mercaptan type development inhibitor-releasing compound is incorporated in the lower layer emulsion having a lower sensitivity than the upper layer emulsion, improvement of the granularity in the lower layer by the mercaptan type development inhibitor released at the development step is attained in not only the density region to which the lower layer emulsion contributes, but the entire density range from the toe portion to the high density region. In conventional negative photosensitive materials for color photography having a composite structure according to the twolayer method, the main latitude is generally provided by the lower layer. In such case, in order to broaden the latitude in the lower layer, a silver halide emulsion having a broad particle size distribution is employed as the emulsion. In contrast, if the mercaptan type development inhibitor-releasing compound is used in the lower layer, even when a silver halide emulsion having a narrow particle size distribution is employed, characteristics of a moderate gradient and a broad latitude can be attained. Furthermore, if a silver halide emulsion of a narrow particle size distribution is used for the lower layer, great improvement in the granularity and sharpness can be attained. Of course, by the above-mentioned intra-image effects of the mercaptan type development inhibitor-releasing compound, the layer incorporated with this compound can have a highly improved sharpness as compared with the conventional two-layer method in which a low sharpness is one of conspicuous defects. Likewise, if the mercaptan type development inhibitor is diffusible, it also inhibits the development in layers other than the source layer and hence, the color reproducibility can be greatly improved by the inter-image effects. If the development inhibitor-releasing compound is incorporated into both the upper and lower layers of the two-layer structure, the above-mentioned effects attained by incorporating the development inhibitor-releasing compound into only the upper layer or the lower layer can be attained simultaneously, and photographic characteristics such as fog, sensitivity, granularity — which is the most important photographic property — can be markedly improved.

As is apparent from the foregoing description, if at least one of color image-forming unit layer of a multilayer photosensitive material for color photography is divided into upper and lower layers so that the upper layer has a higher sensitivity and a lower maxmum developed color density than the lower layer and if a mercaptan type development inhibitorreleasing compound is incorporated into at least one of said upper and lower layers, there can be attained various advantages that cannot be expected from the above-mentioned characteristics of the conventional two composite layer structure and from the conventional technique of using mercaptan type development inhibitor-releasing compounds.

The mercaptan type development inhibitor-releasing compound to be used in this invention is a compound capable of reacting with an oxidation product of a color developing agent at the development step to form a substantially colorless compound and capable of releasing a mercaptan type development inhibitor at the development step. Various compounds of this type are known in the art. In this invention, among these known mercaptan type development inhibitor-releasing compounds, those represented by the following formula

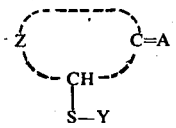

in which Z indicates a group of non-metallic atoms necessary for forming a carbon ring nucleus or heterocyclic ring nucleus, Y is a group capable of forming on cleavage of the thioether group a mercaptan type compound having a development inhibiting activity together with the sulfur atom, and A stands for an oxygen atom or a group =NR′ in which R′ stands for a hydroxyl group or optionally substituted amino group, are effectively employed, because they have a high reactivity with an oxidation product of a color developing agent.

These compounds form substantially colorless compounds on reaction with oxidation products of color developing agents. Since these substantially colorless compounds do not constitute parts of finally obtained color images, the above compounds can be applied to any of the color image-forming unit layers. Further, since these compounds have a very high reactivity with oxidation products of color developing agents, very good intra-image effects and inter-image effects can be obtained even when they are used in small amounts.

In typical instances of compounds represented by the above general formula, the ring formed by Z is, for example, a saturated or unsaturated 5-, 6- or 7-membered carbon ring, or a 5-, 6- or 7-membered heterocyclic ring including nitrogen, oxygen, sulfur or the like. As typical instances of the carbon ring, there can be mentioned cyclopentanone, cyclohexanone and cycloheptanone rings, which may have one or more of such substituents as alkyl groups, aryl groups, alkoxy groups, aryloxy groups and halogen atoms. Further, these carbon rings may contain a condensed ring at a suitable position. As typical instances of such condensed ring, there can be mentioned indanone, benzcyclohexenone and benzcycloheptenone rings. As typical instances of the heterocyclic ring, there can be mentioned piperidone rings ( for example, 2-piperidone, 3-piperdone and 4-piperidone rings ), lactone rings ( for example, 4-, 5-, 6- and 7-membered lactone rings ), lactam rings ( for example, pyrrolidone rings ), hydantoin rings, indole rings ( for example, oxyindole ring ), and the like. These heterocyclic rings may have one or more of such substituents as alkyl groups, aryl groups, alkoxy groups, arylthio groups, acyl groups, halogen atoms and water-soluble groups ( for example, carboxylic and sulfonic groups ). Further, these heterocyclic rings may contain a condensed ring at a suitable position ( for example, condensed heterocyclic or aromatic rings ). Moreover, these carbon and heterocyclic rings may have one or more of -SY groups ( Y is as defined above ) on carbon atoms adjacent to the carbonyl group and oxime or hydrazone group. Y is a group forming on cleavage of the thioether linkage a compound having a development-inhibiting activity such as aryl-mercapto compounds, heterocyclic compounds, thioglycolic acid compounds, cysteine and glutathione, together with the sulfur atom. As typical instances of the mercapto compound formed from Y, there can be mentioned heterocyclic mercapto compounds such as mercaptotetrazole compounds, especially, 1-phenyl-2-mercaptotetrazole, 1-nitrophenyl-5-mercaptotetrazole and 1-naphthyl-5-mercaptotetrazole, mercaptothiazole compounds, especially, 2-mercaptobenzthiazole and mercaptonaphthothiazole, mercapto-oxathiazole compounds, mercaptopiperidine compounds, mercaptothiadiazole compounds, especially, 2-mercaptothiaziazolotriazine, mercaptotriazine compounds, mercaptotriazole compounds, and mercaptobenzene compounds, especially, 1-mercapto-2-benzoic acid, 1-mercapto-2-nitrobenzene and 1-mercapto-3-heptadecanoylaminobenzene.

Specific examples of compounds represented by the above general formula are as follows:

1. 2- ( 1-phenyl-5-tetrazolylthio ) cyclopentanone
2. 2- ( 1-phenyl-5-tetrazolylthio ) cyclohexanone
3. 2,5-di ( 1-phenyl-5-tetrazolylthio ) cyclopentanone
4. 2- (2-benzoxazolylthio ) cyclopentanone oxime
5. 2- (1-phenyl-5-tetrazolylthio )-4-dodecyloxyindanone-(1)
6. 2- (1-phenyl-5-tetrazolylthio )-6-[α - ( 2,4-di-tertamylphenoxy ) acetamido]indanone-(1)
7. 2- (1-phenyl-5-tetrazolylthio )-7-tert-butylindanone-(1)
8. 2- (1-phenyl-5-tetrazolylthio )-4-palmitoylamido-6-chloroindanone-(1)
9. 2- (1-phenyl-5-tetrazolylthio ) cyclobutanone oxime
10. 2- (1-phenyl-5-tetrazolylthio )-5-tert-butylindanone(1)-semicarbazone
11. 2,5-di-(1-phenyl-5-tetrazolythio)-4-tert-octylcyclohexanone
12. 2-(1-phenyl-5-tetrazolylthio)indanone-(1)
13 2-(1-phenyl-5-tetrazolylthio)-6-[α -(2,4-di-tertamylphenoxy)acetamido] indanone-(1) oxime
14. 2,5-di(1-phenyl-5-tetrazolylthio)cyclododecane
15. 2-(2-benzoxazolylthio)-5-pentadecyloxycyclopentanone
16. 2-(2-nitrophenylthio)-6-stearoyloxycyclohexanone
17. 2-(1-phenyl-5-tetrazolylthio)-5-isoamyl-5'-phenylcyclopentanone
18. 2-(1-phenyl-5-tetrazolylthio)-5-dodecylindanone-(1)
19. 2-(1-phenyl-5-tetrazolylthio)-5-decylcyclopentanone
20. 2-(2-carboxyphenylthio)-5-decylcyclopentanone
21. 2-(1-phenyl-5-tetrazolylthio)-6-tert-butylindanone-(1)
22. 2,5-di(1-phenyl-5-tetrazolylthio)-3-tert-octylcyclopentanone
23. 2-(1-phenyl-5-tetrazolylthio)tetralone-(1)
24. 2-(1-phenyl-5-tetrazolylthio)-4-methyl-7-dodecyloxyindanone-(1)
25. 2-(1-phenyl-5-tetrazolylthio)5-[α-(2,4-di-tertamylphenoxy)acetamido] indanone-(1)
26. 2-(1-phenyl-5-tetrazolylthio)-7-[α-(2,4-di-tertamylphenoxy)acetamido] indanone-(1)
27. 1-n-dodecyl-3-(1-phenyl-5-tetrazolylthio)-4-piperidine
28. 1-n-dodecyl-3,5-di(1-phenyl-5-tetrazolylthio)-4-piperidone oxime
29. 2-(1-phenyl-5-tetrazolylthio)-4-(2,4-di-tert-amylphenoxy acetamido)-1-indanone
30. 2-(1-phenyl-5-tetrazolylthio)-4-octadecylsuccinimido-1-indanone These compounds can readily be synthesized by, for example, methods disclosed in Japanese Patent Applications No. 118,892/72, No. 13,811/73 and No. 99,987/73.

In this invention, it is possible to employ, as well compounds represented by the above general formula, mercaptan type development inhibitor-releasing compounds, such as those disclosed in German Patent Application Laid-Open Specification No. 1,547,640. However, the effects of these compounds are somewhat lower than those of the compounds represented by the above general formula. In order to attaining the object of this invention most effectively, it is preferred to employ compounds represented by the above general formula.

In accordance with one of preferred embodiments of this invention, at least one of the above-mentioned color imageforming unit layers is composed of upper and lower layers, a mercaptan type development inhibitor-releasing compound is incorporated into at least one of said upper and lower layers, a coupler is incorporated in an amount of not higher than 3 mole % based on the silver halide in the upper layer including a silver halide emulsion having a higher sensitivity than the silver halide emulsion of the lower layer while controlling the maximum developed color density in the upper layer to 0.2 to 0.7 and the dry thickness of the upper layer is adjusted to not larger than 2 G2z.

In the foregoing embodiment, the effects of this invention are further enhanced, and sensitivity, granularity and sharpness are further improved. More specifically, by making the amount of the silver halide contained in the upper layer a considerable excess over the amount of the coupler contained in the upper layer and controlling the maximum developed color density in the upper layer to a low level ranging from 0.2 to 0.7, the granularity of the upper layer can be further improved, and by lessening the thickness of the upper layer, the effect of diffusing the oxidation product of a color developing agent from the upper layer to the lower layer can be enhanced, and hence, the sensitivity, and gradient can be further improved.

In conventional technique, the degradation of granularity was inavoidable when oxidation products of developing agent diffused from the layer having less coupler content to the layer having more coupler content.

In contrast, in this invention, the sensitivity and gradient of a photosensitive material for color photography can be effectively improved by the incorporation of a mercaptan type development-inhibitor releasing compound into at least one of the upper layer and the lower layer, without any degradation of granularity.

In accordance with another preferred embodiment of this invention, at least one of the above-mentioned color imageforming layers unit is composed of upper and lower layers, high-sensitivity silver halide emulsion of a silver iodide content of at least 6 mole % is used for the upper layer as a high-sensitivity emulsion layer, and a silver halide emulsion in which the silver iodide content is lower by at least 2 mole % than the silver iodide content in the upper layer is used for the lower layer. In this preferred embodiment, a multi-layer photosensitive material for color photography having further improved color reproducibility and sharpness can be obtained. More specifically, by employing a silver halide emulsion having a high silver iodide content as the emulsion for the upper layer and a silver halide emulsion of a lower silver iodide content which more readily undergoes development effects than does that of the upper layer, as the emulsion for the lower layer, it is made possible to provide a two-layer structure having high inter-image and intra-image effects.

In accordance with still another embodiment of this invention, at least one of the above-mentioned color image-forming unit layers is composed of upper and lower layers, and in the upper layer as a high-sensitivity emulsion layer, a coupler having a lower color-forming rate than the coupler of the lower layer is employed. In this preferred embodiment, since the color-forming rate of the coupler of the upper layer is lower than that of the coupler of the lower layer, the oxidation product of a color developing agent formed in the upper layer is diffused relatively far, so that granularity can be highly improved.

In accordance with still another preferred embodiment of this invention, at least one of the above-mentioned color image-forming unit layers is composed of upper and lower layers, and the ratio of the color coupler to the colorless coupler in the upper layer is higher than said ratio in the lower layer. In this preferred embodiment, the masking effect is enhanced in the upper layer portion and the shortage of the masking effect in the lower layer portion is compensated by the inter-image effect, whereby the color reproducibility is improved and the entire masking dye density is reduced to facilitate classification of the negative film at the printing process and shorten the printing time. The term "colored coupler" used herein includes not only so-called azo-type colored couplers having active positions substituted by an arylazo group which is split off on coupling with an oxidation product of a color developing agent of the primary amine type, but also so-called DDR colored couplers having active positions substituted by a diffusible dye group which is split off on coupling.

If features of the above-mentioned preferred embodiments are combined to form a two-layer structure in at least one of the above-mentioned color image-forming unit layers, there can be provided a multi-layer photosensitive material for color photography which is most excellent in such photographic characteristics as fog property, sensitivity, granularity, sharpness, color reproducibility and the like. More specifically, in accordance with the most preferred embodiment of this invention, there can be obtained a multi-layer photosensitive material for color photography which is most excellent in fog property, sensitivity, granularity, sharpness, color reproducibility and other photographic characteristics, wherein at least one of the color image-forming unit layers is a composite of upper and lower layers, a mercaptan type development inhibitor-releasing composed compound is contained in at least one of said upper and lower layers, a silver halide having a silver iodide content of at least 6 mole % is employed for a high sensitivity emulsion of the upper layer, a coupler having a color-forming rate lower than that of the coupler in the lower layer is contained in the upper layer, the ratio of the colored coupler to the colorless coupler in the upper layer is made larger than in the lower layer according to need, the amount of the coupler contained in the upper layer is not larger than 3 mole % based on the silver halide, the maximum developed color density in the upper layer is controlled to a level of 0.2 to 0.7, the thickness of the upper layer is not larger than 2 G2z, and wherein an emulsion comprising a silver halide containing silver iodide in an amount smaller by at least 2 mole % than the silver iodide content in the silver halide of the upper layer is used as the emulsion of the lower layer.

In this invention, high-sensitivity and low-sensitivity emulsion layers to be used as upper and lower layers of a color image-forming unit layer are coated on a support, and an intermediate layer may be interposed between these two layers, for example, a layer of hydrophilic colloid such as gelatin, if desired. As pointed above, these two layers differ from each other with respect to the sensitivity. In order to obtain a continuous sensitivity, layers overlap each other. More specifically, it is desired that the upper layer composed of a high-sensitivity emulsion and the lower layer composed of a low-sensitivity emulsion have substantially juxtaposed sensitivities.

A characteristic two-layer structure of this invention having an upper layer of a high-sensitivity emulsion and a lower layer of a low-sensitivity emulsion can be applied to any optional color image-forming unit of the multi-layer photosensitive material for color photography. In these color image-forming units, there are generally incorporated couplers forming dye upon reaction with oxidized primary aromatic amine color developing agent. For example, a yellow coupler having an active methylene group inserted getween carbonyl groups at the 2-position is incorporated in a blue-sensitive silver halide emusion layer, a 5-pyrazolone magenta coupler such as disclosed in specifications of Japanese Patent Applications Nos. 8443/69; 69017/72; 94604/72; 28120/73 and 34471/73 is incorporated into a green-sensitive silver halide emulsion, and a cyan coupler of the naphthol or phenol type is incorporated into a red-sensitive silver halide emulsion layer. These couplers may be either so-called two-equivalent dye-forming couplers or so-called four-equivalent dye-forming couplers. They may also be so-called masking couplers having at the active positions thereof arylazo groups or diffusible dye groups capable of being split off in the coupling reaction. Further, these couplers may have in the molecule a water solubility-imparting group such as a sulfonic or carboxylic group. Among these couplers, those having oleophilic characteristics can be dissolved and dispersed in high-boiling-point organic solvents such as dibutyl phthalate or low-boiling-point organic solvents such as chloroform, acetone and dimethylformamide. Water-soluble couplers are dissolved in aqueous alkali and they are added in the dissolved state directly to a silver halide emulsion.

In this invention, it is preferred that a coupler having color-forming rate lower than that of the coupler of the lower layer is used in the upper layer. Preferred combinations of couplers used for the upper layer and lower layer are as shown below.

| Layer | Kind of Coupler | Lower Layer | Upper Layer |
|---|---|---|---|
| Blue-sensitive layer | yellow coupler | α-(4-nitrophenoxy)-α-pivalyl-5-[α-(2,4-di-tert-amylphenoxy)-butyramide]-2-chloroacetanilide | α-pivalyl-5-[γ-2,4-di-tert-amylphenoxy)-butyramide]-2-chloroacetanilide |
| green-sensitive layer | colorless magenta coupler | 1-(2,4,6-trichlorophenyl)-3-3-[α-(2,4-di-tert-amylphenoxy)-acetamide] anilino -5-pyrazolone | 1-(2,4,6-trichlorophenyl)-3-3-[α-(2,4-di-tert-amylphenoxy)-acetamido]benzamide -5-pyrazolone |
| | colored magenta coupler | 1-(2,4,6-trichlorophenyl)-3-3-[α-(2,4-di-tert-amylphenoxy)-acetamido] anilino -4-(4-methoxy-phenylazo)-5-pyrazolone | 1-(2,4,6-trichlorophenyl)-3-3-[α-(2,4-di-tert-amylphenoxy)-acetamido]benzamido -4-methoxyphenylazo)-5-pyrazolone |
| red-sensitive layer | colorless cyan coupler | 1-hydroxy-(2-dodecyloxy)-2-naphthanilide | 1-hydroxy-N-[δ-(2,4-di-tert-amylphenoxy)butyl]-2-naphthamide |
| | colored cyan coupler | 1-hydroxy-4-(4-ethoxy-phenylazo)-N-[δ-(2,4-di-tert-amylphenoxy) butyl]-2-naphthamide | 1-hydroxy-4-(2-acetophenylazo)-N-[δ-(2,4-di-tert-amylphenoxy) butyl]-2-naphthamide |

In addition to the above combinations, there are many other combinations of couplers differing in the color-forming rate. An optional combination can be chosen among them and used in this invention depending on the intended purpose.

In case the above-mentioned two-layer structure of this invention is applied to a red-sensitive or green-sensitive emulsion layer of a negative film for color photography, it is desired that a colorless coupler be used in combination with a colored coupler, but in some cases it is possible to employ even a combination of couplers in which the complementary color relation is completely neglected, though the above relation should be considered in the conventional coupler-using techniques. More specifically, coupler-using techniques adapted for photosensitive material for color air photography and color X-ray photography can be employed in this invention.

The mercaptan type development inhibitor-releasing compound to be used in this invention can be incorporated into layers other than the color image-forming layer having the above-mentioned two-layer structure. For example, in a multi-layer photosensitive material for color photography comprising blue-sensitive, green-sensitive and red-sensitive emulsion layers, each of the blue-sensitive and red-sensitive layers having a monolayer structure and only the green-sensitive emulsion layer being composed of upper and lower layers, the mecaptan type development inhibitor-releasing compound can be incorporated not only into the green-sensitive emulsion layer of the two-layer structure but also into the bluesensitive emulsion layer and or the red-sensitive emulsion layer.

The mercaptan type development inhibitor-releasing compound may be incorporated into non-photosensitive emulsion layers or intermediate layers.

The high-sensitivity emulsion to be used for the upper layer in this invention has generally a coarser silver halide particle size than the low-sensitivity emulsion for the lower layer. In general, high-sensitivity silver halide particles have an average size of at least 0.75 G2z, but in this invention it is preferred that particles having an average size exceeding 1 be employed. The amount of the mercaptan type development inhibitor-releasing compound incorporated into upper and lower layer emulsion varies depending on the kind of the compound and the layer into which the compound is incorporated and other factors, but in general, it is preferred that when the compound is incorporated into the upper layer, the amount incorporated is 0.01 to 2 g per mole of the silver halide and that when it is incorporated into the lower layer, the amount incorporated is 0.05 to 10 g per mole of the silver halide. These mercaptan type development inhibitor-releasing compounds can be used singly, but in some cases two or more of such compounds can be used in combination.

The arrangement of photosensitive silver halide emulsion layers is very important in a multi-layer photosensitive material for color photography, and red-sensitive, green-sensitive and blue-sensitive silver halide emulsion layers are coated in the above order on a support. In each photosensitive emulsion layer, the silver image is developed, and cyan magenta and yellow dye images corresponding with the silver image are formed in the respective layers, whereby a colored image is obtained. As the color developing agent to be used for color development of these dyes, there can be mentioned phenylene diamines and their derivatives. Typical instances of the color developing agents include sulfates, hydrochlorides and sulfides of N-N-diethyl-p-phenylene diamine, N-ethyl-N-hydroxyethyl-p-phenylene diamine, N-ethyl-N-hydroxyethyl-2-methyl-p-phenylene diamine, N-ethyl-N-β-methanesulfonamidoethyl -3-methyl-4-aminoaniline and the like. Phenylene diamine type color developing agents inclusive of those other than those exemplified above can be effectively used for color development of a multi-layer photosensitive material for color photography according to this invention.

In a multi-layer photosensitive material for color photography according to this invention, as the hydrophilic colloid to be used advantageously for formation of photosensitive emulsions, there can be mentioned, for example gelatin colloidal albumin, agar, gum arabic, alginic acid, cellulose derivatives such as cellulose acetate hydrolyzed to have an acetyl content of 19 to 26 %, acrylamide, imidated polyacrylamide, zein, vinyl alcohol polymers containing a urethane-carboxylic or cyanoacetyl group, such as vinyl alcohol-vinyl cyanoacetate copolymers, polyvinyl alcohols, polyvinyl pyrrolidone, hydrolyzed polyvinyl acetate, polymers obtained by polymerizing a protein or saturated acylated protein with a vinyl group-containing monomer, and the like. Any silver halides usually employed for ordinary silver halide photographic emulsions, such as silver bromide, silver chloride, silver iodobromide, silver chlorobromide and silver chloroiodobromide can be used for formation of an emulsion in this invention.

Silver halide emulsions to be used for formation of a multi-layer photosensitive material for color photography according to this invention can be prepared not only according to methods customarily adopted in the art but also other various methods, such as the single jet precipitation method, the double jet precipitation method, the method disclosed in Japanese Patent Publication No. 7772/71, the method disclosed in the specification of U.S. Pat. No. 2,592,250, i.e., the method for preparing a so-called conversion emulsion comprising forming an emulsion of particles of silver salts, at least a part of which is composed of a silver salt having a solubility higher than the solubility of silver bromide and converting at least a part of said particles to silver bromide or silver iodobromide, the method for preparing a silver halide emulsion having silver halide particles of adjusted grain distribution and adjusted distribution and content of silver iodide which is disclosed in Japanese Patent Publication No. 18103/1971, and Japanese Patent Application Laid Open No. 65925/1973, the method for preparing a so-called Lippmann emulsion comprising a finely divided silver halide having an average particle size not exceeding 0.1 G2z, and other methods. This silver halide emulsion can be sensitized by chemical sensitizing agents, namely sulfur sensitizing agents such as allylthiocarbamide, thiourea, allyl isocyanate and cystine, active or inactive selenium sensitizing agents, and novel metal sensitizing agents such as gold compounds, e. g., potassium chloroaurate, auric trichloride, potassium auric thiocyanate and 2-aurothiabenzothiazole methylchloride, palladium compounds, e.g., ammonium chloropalladate and sodium chloropalladite, platinum compounds, e.g., potassium chloroplatinate, ruthenium compounds, rhodium compounds and iridium compounds. Combinations of these chemical sensitizing agents can also be employed. Further, the emulsion can be reductively sensitized by reducing agents, and it can be stabilized by triazoles, imidazoles, azaindenes, benzothiazolium, compounds, zinc compounds, cadmium compounds, mercaptans or mixtures of these compounds. Still furhter, the emulsion can be incorporated with a sensitizing compound of the thioether, quaternary ammonium salt or polyalkylene oxide. Moreover, the emulsione can be incorporated with wetting agents, plasticizers and film property-improving agents, such as glycerin, dihydroxyalkanes, e.g., 1,5-pentanediol, ethylenebisglycolic acid esters, bis-ethoxydiethyleneglycol succinate, and finely divided water-dispersible macromolecular compounds obtained by emulsion polymerization. Still in addition, other various photographic additives such as film hardening agents, e.g., ethylene-imine compounds, dioxane derivatives, hydroxypolysaccharide, dicarboxylic chlorides and bis-esters of methanesulfonic acid, coating assistants, e.g., saponin and sulfosuccinic salts, fluorescent whitening agents, antistatic agents, anti-staining agents, and the like can be incorporated into the emulsion.

Blue-sensitive, green-sensitive and red-sensitive emulsions to be used for formation of a multi-layer photosensitive material for color photography according to this invention can be optically sensitized by suitable sensitizing dyes so that they are rendered sensitive to desired wavelength regions,. As the sensitizing dye, there can be employed, for example, cyanine dyes, merocyanine dyes, composite cyanine dyes and the like. These sensitizing dyes can be used singly or in the form of mixtures of two or more.

The multi-layer photosensitive material for color photography according to this invention is prepared by coating blue-sensitive, green-sensitive and red-sensitive emulsion layers optionally incorporated with various photographic additives such as mentioned above and other constituent layers on a corona discharge-treated, flame-treated or ultraviolet ray-treated support optionally through an undercoat layer and an intermediate layer. Supports advantageously used in this invention include, for example, baryta paper, polyethylene-coated paper, polypropylene artificial paper, glass sheet, cellulose acetate, cellulose nitrate, polyester film such as polyethylene terephthalate film, polycarbonate film, polystyrene film and the like. A suitable support is chosen among these supports depending on the intended use of the multilayer photosensitive material for color photography. In this invention, the intended effects can be sufficiently attained regardless of the arrangement of the respective photosensitive emulsion layers (color image-forming unit layers). For instance, in the case of a photosensitive material for ordinary photography, it is preferred that a red-sensitive emulsion layer, a green-sensitive emulsion layer and a blue-sensitive layer are disposed in this order from the support side. Further, in the case of a photosensitive printing paper, it is preferred that a blue-sensitive emulsion layer, a green-sensitive emulsion layer and a red-sensitive emulsion layer are disposed in this order from the support side.

Moreover, filter layers, backing layers for curl preventing, protective layers, anti-halation layers and other layers can be used as constituent layers in combination with these photosensitive emulsion layers. Hydrophilic colloids that are used for these photosensitive emulsion layers can also be employed as binders for these constituent layers. Further, various photographic additives such as mentioned with respect to the photosensitive emulsion layers can be incorporated into these constituent layers.

It is advantageous that after light exposure, the multilayer photosensitive material for color photography according to this invention is subjected to color development according to a conventional color development method adapted for color development of ordinary coupler-self-containing silver halide photosensitive materials for color photography. In the case of the reversal development method, the photosensitive material is first developed with a black and white developer, then the photosensitive material is exposed to white light or treated with a bath containing a fogging agent, and the photosensitive material is subjected to color development with developer containing a color developing agent. After the color development treatment, the photosensitive material is treated with a bleaching liquid containing as an oxidant a ferricyanide or a ferric salt of an amino-polycarboxylic acid, and it is subjected to the fixing treatment with a fixing solution containing a solvent for silver salts such as thiosulfates to remove the silver salt and the residual silver halide while leaving a dye image. Instead of the bleaching solution and fixing solution a one-bath type bleaching and fixing solution containing an oxidant such as a ferric salt of an amino-polycarboxylic acid and a solvent for silver salts such as a thiosulfate can be used to effect bleaching and fixation simultaneously. Further, such treatments as water washing, stopping and stabilizing treatments can be performed in combination with the foregoing color development, bleaching and fixing treatments or color development and bleaching-fixing treatments. These treatments can be conducted at a high temperature such as exceeding 30°C. in a very short time.

This invention will now be described more detailedly by reference to Examples which by no means limit the scope of this invention.

EXAMPLE 1

The following layers were coated on a support composed of a cellulose triacetate film in the order of from layer 1 to layer 9, to form Sample 1.

Layer 1 (anti-halation layer)

Black colloidal silver was dispersed in an aqueous solution of gelatin, and the dispersion was coated so that the amount of gelatin coated was 3 g/m² and the amount of silver coated was 0.3 g/m².

Layer 2 (cyan dye-forming red-sensitive silver halide emulsion layer)

A mixture of 5 parts by weight of 1-hydroxy-4-(2-ethoxycarbonylphenylazo)-N-[α-(2,4-di-tert-amylphenoxy)butyl]-2-naphthamide and 20 parts by weight of 1-hydroxy-N-[α-(2,4-di-tert-amylphenoxy)butyl]-2-naphthamide was dissolved as a cyan coupler into tri-o-cresyl phosphate, and the solution was dispersed into an aqueous solution of gelatin. A silver iodobromide gelatin emulsion incorporated with this dispersion was coated in a dry thickness of 6.5μ so that the amount of gelatin coated was 4.5 g/m², the amount of silver coated was 3.4 g/m², and the amount of the cyan coupler coated was 1.4 g/m². This emulsion was a 1 : 1 mixture of a high-sensitivity silver iodobromide emulsion having a silver iodide content of 8 mole % and a particle size of 1.5 to 0.7μ and a low-sensitivity silver iodobromide emulsion having a silver iodide content of 8 mole % and a particle size of 0.5 to 0.2μ, and this emulsion was optically sensitized by a sensitizing dye so that it was rendered sensitive to red rays (600 to 700 nm).

Layer 3 (intermediate layer)

An aqueous solution of gelatin was coated so that the amount of gelatin coated was 1.3 g/m².

Layer 4 (magenta dye-forming green-sensitive low-sensitivity silver halide emulsion)

A mixture of a magenta coupler composed of 5 parts by weight of 1-(2,4,6-trichlorophenyl)-3-{3-[α-(2,4-di-tertamylphenoxy)acetamido] anilino}-4-(methoxyphenylazo)-5-pyrazolone and 26 parts by weight of 1-(2,4,6-trichlorophenyl)-3-[3-(α-2,4-di-tert-amylphenoxy)-acetamido]benzamido5-pyrazolone (mole ratio = 1 : 6.9) and 2 parts by weight of the compound (6) as a development inhibitor-releasing agent was dissolved in tri-o-cresyl phosphate and the solution was dispersed in an aqueous solution of gelatin. A silver iodobromide gelatin solution incorporated with this dispersion was coated to a dry thickness of 4.0 m so that the amount of gelatin gelatin was 2.9 g/m², the amount of silver coated was 1.4 g/m², and the amount of the mixture of the two magenta couplers and compound (6) coated was 0.9 g/m² (the amount of the couplers being 10 mole % based on silver). This emulsion was a silver iodobromide emulsion having a particle size of 0.8 to 0.5 G2z and a silver iodide content of 8 mole % and it was optically sensitized with a sensitizing dye so that it was rendered sensitive to green rays (500 to 600 nm).

Layer 5 (magenta dye-forming green-sensitive high-sensitivity silver halide emulsion)

A mixture of a magenta coupler composed of 5 parts by weight of 1-(2,4,6-trichlorophenyl)-3-{3-[α-(2,4-di-tertamylphenoxy)acetamido]-anilino}-4-(methoxyphenylazo)-5-pyrazolone and 26 parts by weight of 1-(2,4,6-trichlorophenyl)-3-{3-[α-(2,4-di-tert-amylphenoxy)acetamido]}-5-pyrazolone (mole ratio = 1 : 6.9) and 0.2 part by weight of the compound (6) as a development inhibitor-releasing compound was dissolved in tri-o-cresyl phosphate, and the solution was dispersed in an aqueous solution of gelatin. A silver iodobromide gelatin emulsion incorporated with this dispersion was coated in a dry thickness of 3.0 μ so that the amount coated of gelatin coated was 2.5 g/m², the amount of silver coated was 1.7 g/m² and the amount of the mixture of the two magenta couplers and compound (6) coated was 0.38 g/m² (the amount of the coupler being 3.5 mole % based on silver). This emulsion was a silver iodobromide emulsion having a particle size of 1.5 to 0.7 G2z and a silver iodide content of 8 mole %, and it was optically sensitized by a sensitizing dye so that it was rendered sensitive to green rays (500 to 600 nm).

Layer 6 (intermediate layer)

An aqueous solution of gelatin was coated so that the amount coated of gelatin was 1.3 g/m².

Layer 7 (yellow colloidal filter layer)

Yellow colloidal silver was dispersed in an aqueous solution of gelatin, and the dispersion was coated so that the amounts coated of silver and gelatin was 0.1 g/m² and 1.3 g/m², respectively.

Layer 8 (yellow dye-forming blue-sensitive silver halide emulsion layer)

α-(4-nitrophenoxy)-α-pivalyl-5-[γ-(2,4-di-tert-amylphenoxy)-butyramido]-2-chloroacetanilide was dissolved as a yellow coupler in dibutyl phthalate, and the solution was dispersed in an aqueous solution of gelatin. A silver iodobromide gelatin emulsion incorporated with this dispersion was coated in a dry thickness of 6.0 G2z so that the amounts coated of gelatin, silver and yellow coupler were 4.0 g/m², 1 g/m² and 1.6 g/m², respectively. This emulsion had a silver iodide content of 7 mole % and was sensitive to blue rays (400 to 500 nm).

Layer 9 (protective layer)

An aqueous solution of gelatin was coated so that the amount coated of gelatin was 1.3 g/m².

Separately, Comparative Sample 1 was prepared in the same manner as above except that the following single layer was formed instead of layers 4 and 5 of Sample 1 and no development inhibitor-releasing compound was incorporated. Namely, the magenta dye image-forming unit layer was prepared by mixing equimolar amounts of a high-sensitivity silver iodobromide emulsion having a silver iodide content of 8 mole % and a particle size of 1.5 to 0.7μ and a low-sensitivity silver iodobromide emulsion having a silver iodide content of 8 mole % and a particle size of 0.5 to 0.2 μ and coating the emulsion in a dry thickness of 7.0 G2z so that the amount of gelatin coated was 5.4 g/m², the amount of silver coated was 3.0 g/m² and the amount of a magenta coupler (mixture including the same two magenta couplers as used in layer 4 of Sample 1 at the same mixing ratio as in Sample 1) coated was 1.35 g/m² (the amount of the coupler being 7 mole % based on silver).

Comparative Sample 2 was prepared in the same manner as above except that no development inhibitor-releasing compound was incorporated in layer 4 or layer 5 in the structure of Sample 1. Namely, the following layers 4 and 5 were formed:

Layer 4

This layer was formed in the same manner as in the case of layer 4 of Sample 1 by using a silver iodobromide emulsion having a particle size of 0.8 to 0.2μ without incorporation of the development inhibitor-releasing compound.

Layer 5

This layer was formed in the same manner as in the case of layer 5 of Sample 1 except that the development inhibitor-releasing compound was not incorporated and the emulsion was so that the amount coated of silver coated was 1.4 g/m² and the amount of the mixture of the two magenta couplers coated was 0.31 g/m² (the amount of the coupler being 3.5 mole % based on silver).

These comparative sample emulsions were so prepared that the best sensitivity and gradient attainable in the absence of a development inhibitor-releasing compound would be obtained.

So prepared Sample 1 and Comparative Samples 1 and 2 were subjected respectively to separated blue light, green light and red light exposures and white light exposure through step wedges, and they were then subjected to the following treatments:

| Treatment Step (38°C.) | Treatment Time |
|---|---|
| color development | 3 minutes and 15 seconds |
| bleaching | 6 minutes and 30 seconds |
| water washing | 3 minutes and 15 seconds |
| fixation | 6 minutes and 30 seconds |
| water washing | 3 minutes and 15 seconds |
| stabilization | 1 minute and 30 seconds |

Compositions of treating liquids used in the above treatments were as shown below: Color Developing Solution

| | |
|---|---|
| 4-amino-3-methyl-N-ethyl-N-(β-hydroxyethyl)-aniline sulfate | 4.8 g |
| anhydrous sodium sulfite | 0.14 g |
| hydroxylamine ½ sulfate | 1.98 g |
| sulfuric acid | 0.74 mg |
| anhydrous potassium carbonate | 28.85 g |
| anhydrous potassium hydrogen-carbonate | 3.46 g |
| anhydrous potassium sulfite | 5.10 g |
| potassium bromide | 1.16 g |
| sodium chloride | 0.14 g |
| nitrilotriacetic acid tri-sodium salt (monohydrate) | 1.20 g |
| potassium hydroxide | 1.48 g |
| water | balance |
| total | 1 liter |
| Bleaching Solution : | |
| ammonium ethylenedinitri-lotetraaceto ferrate (3) | 100.0 g |
| ethylenedinitrilotetraacetic acid diammonium salt | 10.0 g |
| ammonium bromide | 150.0 g |
| glacial acetic acid | 10.0 ml |
| water | balance |
| total | 1 liter |

The pH of the solution was adjusted to 60 by addition of ammonia solution. Fixing Solution:

| | |
|---|---|
| ammonium thiosulfate | 175.0 g |
| anhydrous sodium sulfite | 8.6 g |
| sodium metasulfite | 2.3 g |
| water | balance |
| total | 1 liter |
| Stabilizing Solution : | |
| formalin ( 37 % aqueous solution ) | 1.5 ml |
| konidax ( manufactured by Konishiroku Photo Industry Co. Ltd.) | 7.5 ml |
| water | balance |
| total | 1 liter |

With respect to each of color images formed on Samples 1 and 2, the fog, sensitivity, granularity, sharpness and inter-image effect given to each color image-forming unit layer were measured. The results are shown in Table 1 given below, together with results obtained in the other Examples.

Values of the fog, sensitivity, granularity and sharpness of each color image-forming unit layer are those measured when samples were subjected to white light exposure. The fog value was obtained by reducing the mask density from the minimum density. The sensitivity is expressed as a relative value based on the sensitivity of the magenta dye image-forming unit layer of Sample 1 which was regarded as 100. The value of granularity (RMS) was obtained by multiplying the standard deviation of variation of the density caused by scanning with a microdensitometer of a scanning aperture having diameter of 25μ, by 1000. The sharpness (U0.5) is expressed in a spatial frequency at which the modulation transfer factor was reduced to 50 %.

The inter-image effect was determined by measuring the analytical density with respect to each image-forming unit layer to obtain an analytical gamma value and making a calculation based on this value according to the following formula. A larger value of the inter-image effect indicates that the sample has a higher inter-image effect.

$$\text{Inter-image effect on cyan dye image-forming unit layer} = \frac{\text{analytical gamma value of red light-exposed cyan dye image-forming unit layer}}{\text{analytical gamma value of white light-exposed cyan dye image-forming unit layer}}$$

$$\text{Inter-image effect on magenta dye image-forming unit layer} = \frac{\text{analytical gamma value of green light-exposed magenta dye image-forming unit layer}}{\text{analytical gamma value of white light-exposed magenta dye image-forming unit layer}}$$

$$\text{Inter-image effect on yellow dye image-forming unit layer} = \frac{\text{analytical gamma value of blue light-exposed yellow dye image-forming unit layer}}{\text{analytical gamma value of white light-exposed yellow dye image-forming unit layer}}$$

As is apparent from the results shown in Table 1, Sample 1 of this invention was great superior to Comparative Samples 1 and 2 with respect to fog, sensitivity, granularity and sharpness of the magenta dye image formed in the magenta dye image-forming unit layer. Further, Sample 1 was far superior to Comparative Samples 1 and 2 with respect to the interimage effect on the cyan image-forming unit layer.

It was found that the gradient of the magenta dye image formed on Sample 1 was excellent in the toe of the sensitiometric characteristic curve.

EXAMPLE 2

Sample 2 of the same structure as Sample 1 was prepared in the same manner as in Example 1 except that no development inhibitor-releasing compound was incorporated in the emulsion used for formation of layer 5. The so obtained Sample 2 was light-exposed and subjected to color development in the same manner as in Example 1. Photographic properties of the obtained color image were measured to obtain results shown in Table 1. From these results it is seen that Sample 2 of this invention, like Sample 1 obtained in Example 1, was much superior to Comparative Samples 1 and 2 with respect to photographic properties.

EXAMPLE 3

Sample 3 of the same structure as Sample 1 was prepared in the same manner as in Example 1 except that the following layers were formed instead of layers 4 and 5 of Sample 1.

Layer 4

This layer was formed in the same manner as layer 4 of Sample 1 was prepared, except that the compound (8) was employed as a development inhibitor-releasing compound.

Layer 5

This layer was formed in the same manner as layer 5 of Sample 1 was prepared, except that the compound (8) was used as a development inhibitor-releasing compound and the emulsion was coated in a dry thickness of 1.5 $\mu$ so that the amount of gelatin coated was 1.0 g/m$^2$ and the amount of the mixture of the two magenta couplers and compound (8) coated was 0.2 g/m$^2$ (the amount of the coupler being 1.8 mole % based on silver).

The so obtained Sample 3 was light-exposed and subjected to color development in the same manner as in Example 1, and photographic characteristics of the resulting color image were determined to obtain results shown in Table 1. Although this Sample 1 had layer 5 having a lower maximum developed color density and a smaller thickness than layer 5 of Sample 1 obtained in Example 1, from these results it is seen that Sample 3, like Sample 1, was superior to Comparative Samples 1 and 2 with respect to photographic characteristics, especially the granularity and sharpness of the magenta dye image and the inter-image effect on the cyan image-forming unit layer.

EXAMPLE 4

Sample 4 of the same structure as Sample 1 obtained in Example 1 was formed in the same manner as described in Example 1, except that the following layers were formed instead of layers 4 and 5 of Sample 1.

Layer 4

This layer was formed in the same manner as layer 4 of Sample 1 was prepared, except that the compound (8) was used as a development inhibitor-releasing compound and silver iodobromide containing 5.5 mole % of silver iodide was used as a silver halide.

Layer 5

This layer was formed in the same manner as layer 5 of Sample 1 was prepared, except that the compound (8) was used as a development inhibitor-releasing compound and silver iodobromide containing 12 mole % of silver iodide was used as a silver halide.

The so obtained Sample 4 was light-exposed and subjected to color development in the same manner as in Example 1, and photographic characteristics of the resulting color image were determined to obtain results shown in Table 1. From these results it is seen that Sample 4 of this invention, like Sample 1, was much better than-therefor Comparative Samples 1 and 2 with respect to photographic characteristics, especially the inter-image effect on the magenta image-forming unit layer.

EXAMPLE 5

Sample 5 of the same structure as Sample 1 of Example 1 was prepared in the same manner as described in Example 1, except that the following layers were formed of layers 4 and 5 of Sample 1.

Layer 4

This layer was formed in the same manner as layer 4 of Sample 1 was prepared, except that the compound (11) was used as a development inhibitor-releasing compound and the ratio of the amount used of the colored magenta coupler to the amount used of the colorless magenta coupler was changed to 2 parts by weight to 29 parts by weight (the mole ratio being 1 : 20).

Layer 5

This layer was formed in the same manner as layer 5 of Sample 1 was prepared, except that the compound (11) was used as a development inhibitor-releasing compound and the ratio of the amount used of the colored magenta coupler used to the amount of the colorless magenta coupler used was changed to 9.5 parts by weight to 21.5 parts by weight (the mole ratio being 1 : 3).

The so obtained Sample was light-exposed and subjected to color development in the same manner as in Example 1, and photographic properties of the resulting color image were determined to obtain results shown in Table 1. In this Sample, the colored magenta coupler to colorless magenta coupler ratio was lower in layer 4 and higher in layer 5 than Sample 1 of Example 1. As compared with Sample 1, this Sample 5 was improved in the color reproducibility in dark scenes by the enhanced masking in the toe of the sensitomctric characteristic curve. Further, in this Sample 5, although the masking by the colored coupler in medium density region and high density region was reduced, this reduction was compensated for by the inter-image effect and hence, the color reproducibility was not reduced at all. Accordingly, this Sample 5 was advatageous in that the blue mask density was reduced and the time required for printing could be shortened.

EXAMPLE 6

Sample 6 of the same structure as Sample 1 of Example 1 was prepared in the same manner as described in Example 1, except that the following layers were formed instead of layers 4 and 5 of Sample 1.

Layer 4

This layer was formed in the same manner as layer 4 of Sample 1 was prepared, except that the compound (13) was used as a development inhibitor-releasing compound.

Layer 5

This layer was formed in the same manner as layer 5 of Sample 1 was prepared, except that the compound (11) was used as a development inhibitor-releasing compound, 1-(2,4,6-trichlorophenyl)-3-{3-[α-(2,4-di-tert-amylphenoxy)acetamido] benzamido}-4-(4'-methoxyphenylazo)-5-pyrazolone was used as a colored magenta coupler, the ratio of the amount of the colored magenta coupler used to the amount used of the colorless magenta coupler used was changed to 10 parts by weight to 8.3 parts by weight, and the emulsion was coated so that the amount of the mixture of the two magenta couplers and compound (11) coated was 0.41 g/m² (the amount of the coupler being 3.5 mole % based on silver).

The so obtained Sample 6 was light-exposed and subjected to color development in the same manner as in Example 1, and photographic characteristics of the resulting color image were measured to obtain results shown in Table 1. The coupling rate of the colored magenta coupler for layer 5 of Sample 6 was lower than the coupling rate of the colored magenta coupler for layer 5 of Sample 1, and it was found that in the case of Sample 6 the granularity of the magenta image was especially highly improved.

Example 7

Sample 7 of the same structure as Sample 1 of Example 1 of 1 was prepared in the same manner as described in Example 1, except that the following layers were formed instead of layers 4 and 5 of Sample 1.

Layer 4

This layer was formed in the same manner as layer 4 of Sample 1 was prepared, except that silver iodobromide containing 55 mole % of silver iodide was used as a silver halide.

Layer 5

This layer was formed in the same manner as layer 5 of Sample 1 was prepared, except that silver iodobromide containing 12 mole % of silver iodide was used as a silver halide, 1-(2,4,6-trichlorophenyl)-3-{3-[α-(2,4-di-tert-amylphenoxy) acetamido] benzamido}-4-(4'-methoxyphenylazo)-5-pyrazolone was used as a colored magenta coupler, the ratio of the amount of the colored magenta coupler used to the amount of the colorless magenta coupler used was changed to 10 parts by weight to 8.3 parts by weight, and the emulsion was coated in a dry thickness of 1.5 μ so that the amount of gelatin gelatin was 1.0 g/m² and the amount of the mixture of the two magenta couplers and compound (6) coated was 0.2 g/m² (the amount of the coupler being 1.7 mole % based on silver).

The so formed Sample 7 was light-exposed and subjected to color development in the manner as in Example 1, and photographic properties of the resulting color image were determined to obtain results shown in Table 1. Sample 7 of this invention was excellent in photographic characteristics of the magenta dye image-forming unit layer, especially the sensitivty, granularity and sharpness, and Sample 7 was most therefor excellent in the inter-image effect on the magenta image-forming unit layer and cyan dye image-forming unit layer.

EXAMPLE 8

Sample 8 was prepared in the same manner as Sample 1 was prepared in Example 1, except that the compound (5) was used as a development inhibitor-releasing compound for layers 4 and 5 and the following two-layer structure was formed as the cyan dye image-forming unit layer instead of layer 2 of Sample 1.

Layer 2-1 (Cyan Dye-formign Red-sensitive Low-sensitivity Silver Halide Emulsion Layer; on the Support Side)

A mixture of 2 parts by weight of 1-hydroxy-4-[4-(2-hydroxy-3,6-disulto-1-napthylazo)anilinocarbonyloxy]-N-[δ-(3-n-dedecyloxyphenoxy)butyl]-2-naphthamide-di-sodium salt and 13.4 parts by weight of 1-hydroxy-N-[α-(2,4-di-tert-amylphenoxy)butyl]-2-naphthamide as a cyan coupler and 0.2 part by weight of the compound (5) as a development; inhibitor-releasing compound was dissolved in tri-o-cresyl phosphate, and the solution was dispersed in an aqueous solution of gelatin. A silver iodobromide gelatin emulsion incorporated with this dispersion was coated in a dry thickness of 4 μ so that the amount of gelatin coated was 2.5 g/m², the amount of silver coated was 1.6 g/m², and the amount of the mixture of the two cyan couplers and compound (5) coated was 0.85 g/m². This emulsion was a silver iodobromide emulsion having a particle size of 0.5 to 0.3 and a silver iodide content of 5 mole %, and it was optically senstized by a sensitizign dye so that it was rendered sensitive to red rays (600 to 700 nm), Layer 2-2 (Cyan Dye-forming Red-sensitive High-sensitivity Silver Halide Emulsion Layer)

A mixture of 2 parts by weight of 1-hydroxy-4-[4-(2-hydroxy-3,6-disulfo-1-naphthylazo)anilinocarbonyloxy]-N-[α-(3-n-dodecyloxyphenoxy)butyl]-2-naphthamide as a cyan coupler and 0.2 part by weight of the compound (5) was dissolved in tri-o-cresyl phosphate, and the solution was dispersed in an aqueous solution of gelatin. A silver iodobromide gelatin emulsion incorporated with this dispersion was coated in a dry thickness of 2.5 μ so that the amount of gelatin coated was 1.0 g/m², the amount of silver coated was 2.0 g/m², and the amount of the mixture of the two cyan couplers and compound (5) coated was 0.15 g/m². The emulsion was a silver iodobromide emulsion having a particle size of 1.5 to 0.7 μ and a silver iodide content of 7 mole % and it was optically sensitized so that it was rendered sensitive to red rays (600 – 700 nm).

Comparative Sample 3 of the same layer structure as Sample 8 was prepared in the same manner as above, except that the following layers were formed instead of layers 2-1 and 2-2 of Sample 8.

Layer 2-3

This layer was formed in the same manner as layer 2-1 of Sample 8 was prepared, except that a silver iodobromide emulsion having a particle size of 0.7 to 0.3 μ and a silver iodide content of 6 mole % and being free of the development inhibitor-releasing compound was coated so that the amount coated of the two cyan couplers was 0.85 g/m².

Layer 2-4

This layer was formed in the same manner as layer 2—2 of Sample 8 was prepared, except that the development inhibitor-releasing compound was not incorporated in the emulsion and the emulsion was coated so that the amount coated of silver was 1.4 g/m² and the amount coated of the two cyan couplers was 0.15 g/m².

These emulsions used for preparing Comparative Sample 3 were so adjusted that the best sensitivity and gradient attainable in the absence of a development inhibitor-releasing compound would be obtained.

These Sample 8 and Comparative Sample 3 were light-exposed and subjected to color development in the same manner as in Example 1, and photographic characteristics of the resulting color images were determined to obtain results shown in Table 1. From the results it is seen that Sample 8 was much superior to Comparative Sample 3 with respect to the sensitivity and granularity of the cyan image. Further, Sample 8 was superior to Sample 1 with respect to the photographic characteristics of the cyan image.

EXAMPLE 9

Sample 9 of the same structure as Sample 1 of Example 1 was prepared in the same manner as described in Example 1 except that p-n-dodecyl-α-(1-phenyl-5-tetrazolylthio)acetophenone was used as the development inhibitor-releasing compound for layers 4 and 5.

The so obtained Sample 9 was light-exposed and subjected to color development in the same manner as in Example 1, and the photographic characteristics of the resulting color image were determined to obtain results shown in Table 1. Although Sample 9 was a little inferior to Sample 1 with respect to the gradient of the foot portion of the magenta image, its photographic characteristics were much superior to therefor those of Comparative Samples 1 and 2.

hydroxy-4-[4-(2-hydroxy-3,6-disulfo-1-naphthylazo)anilinocarbonyloxy]-N-[δ-(3-n-dodecyloxphyenoxy]-2-naphthamido disodium salt and 0.2 part by weight of the compound (30) was used instead of compound (5); in the layer 2-2, 2 parts by weight of 4-{3-[4-(8-acetoamido-1-hydroxy-3,6-disulfo-2-napthylazo)acetoamido]anilinocarbonyloxy}-N-[4-(2,4-di-tert-pentylphenoxy)butyl]-1-hydroxy-2-naphthamido-disodium salt was used instead of 1-hydroxy-4-[4-(2-hydroxy-3,6-disulfo-1-naphthylazo)anilinocarbonyloxy]-N-[δ-(3-n-dodecyloxyphenoxy)butyl] 2-naphthamido disodium salt and no development inhibitor-releasing compound was used, in the layer 4, compound ( 29) was used instead of compound (5); and in the layer 5, no development inhibitor-releasing compound was used.

EXAMPLE 11

Sample 11 was prepared as same manner as Sample 10, except that in the layers 2-1 and 2-2, 2 parts by weight of 4-[4-(8-acetoamido-1-hydroxy-3,6-disulfo-2-naphthylazo)phenoxy]-n-[4-(2,4-di-tert-pentylphenoxy)butyl]-1-hydroxy-2-naphthamido disodium salt was used instead of 4-{3-[4-(8-acetoamido-1-hydroxy-3,6-disulfo-2-naphthylazo)phenoxyacetoamido]anilinocarbonyloxy}-N-[4-(2,4-di-tert-pentylphenoxy)butyl]-1-hydroxy-2-naphthamido disodium salt.

As shown in Table 1, Examples 10 and 11 exhibit superiority over the Comparative Samples 1, 2 and 3 in sensitivity, granularity and image sharpness.

What is claimed is:

1. A multi-layer photosensitive material for color photography comprising a support and coated thereon, a first color image-forming layer unit composed of a red-sensitive silver halide emulsion, a second color image-forming layer unit composed of a green-sensitive silver halide emulsion and a third color image-forming layer unit composed of a blur-sensitive silver halide emulsion; characterized in that at least one of said color image-forming layer units has a composite layer structure including a lower layer and an upper layer which are positioned in sequence from the support, said upper layer has a higher sensitivity and a lower maximum developed color density than said lower layer, and at least one of said upper layer and lower layer contains a mercaptan type development inhibitor-releasing compound capable of reacting with an oxidation product of a primary aromatic amine to form a substantially colorless compound.

2. A multi-layer photosensitive material for color photography as defined in claim 1 wherein the coupler Table 1

| | Fog | | | Sensitivity | | | Inter-image effect | | | Granularity (RMS) | | Sharpness ($U_{0.5}$) | |
|---|---|---|---|---|---|---|---|---|---|---|---|---|---|
| Sample | C | M | Y | C | M | Y | C | M | Y | C | M | C | M |
| No. | | | | | | | | | | | | | |
| 1 | 0.20 | 0.11 | 0.12 | 65 | 100 | 200 | 1.53 | 1.10 | 1.05 | 80 | 44 | 48 | 30 |
| 2 | 0.20 | 0.13 | 0.12 | 65 | 140 | 200 | 1.42 | 1.10 | 1.05 | 80 | 47 | 48 | 30 |
| 3 | 0.20 | 0.12 | 0.12 | 65 | 100 | 200 | 1.52 | 1.11 | 1.04 | 80 | 40 | 48 | 26 |
| 4 | 0.20 | 0.11 | 0.12 | 65 | 100 | 200 | 1.50 | 1.40 | 1.06 | 80 | 45 | 48 | 30 |
| 5 | 0.20 | 0.11 | 0.12 | 65 | 100 | 200 | 1.53 | 1.10 | 1.05 | 80 | 45 | 48 | 30 |
| 6 | 0.20 | 0.11 | 0.12 | 65 | 90 | 200 | 1.51 | 1.11 | 1.05 | 80 | 40 | 48 | 30 |
| 7 | 0.20 | 0.11 | 0.12 | 65 | 110 | 200 | 1.50 | 1.40 | 1.05 | 80 | 40 | 48 | 26 |
| 8 | 0.16 | 0.11 | 0.12 | 80 | 100 | 200 | 1.30 | 1.45 | 1.05 | 41 | 44 | 40 | 30 |
| 9 | 0.20 | 0.14 | 0.12 | 65 | 100 | 200 | 1.30 | 1.10 | 1.05 | 80 | 55 | 48 | 33 |
| 1 | 0.20 | 0.15 | 0.12 | 65 | 80 | 200 | 1.09 | 1.12 | 1.06 | 80 | 80 | 48 | 33 |
| 2 | 0.20 | 0.15 | 0.12 | 65 | 95 | 200 | 1.08 | 1.10 | 1.05 | 80 | 60 | 48 | 37 |
| 3 | 0.20 | 0.11 | 0.12 | 80 | 100 | 200 | 1.05 | 1.10 | 1.05 | 62 | 44 | 50 | 30 |
| 10 | 0.20 | 0.12 | 0.12 | 80 | 120 | 200 | 1.40 | 1.20 | 1.05 | 40 | 40 | 42 | 26 |
| 11 | 0.20 | 0.12 | 0.12 | 80 | 120 | 200 | 1.40 | 1.15 | 1.05 | 40 | 40 | 41 | 26 |

In Table 1, C, M and Y indicate characteristic values of the cyan dye image-forming unit layer, magenta dye image-forming unit layer and yellow dye image-forming unit layer, respectively.

EXAMPLE 10

Sample 10 was prepared as same manner as Sample 8, except that in the layer 2-1, 2 parts by weight of 4-{3-[4-(8-acetoamido-1-hydroxy-3,6-disulfo-2-naphthylazo)phenoxyacetoamide] anilinocarbonyloxy}-N-[4-(2,4-di-tert-pentylphenoxy)butyl] -1-hydroxy-2-naphthamido disodium salt was used instead of 1-concentration in said upper layer is lower than that in said lower layer.

3. A multi-layer photosensitive material for color photography as defined in claim 1, wherein said mercaptan type development inhibitor-releasing compound is represented by the following formula;

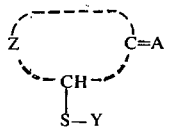

in which Z stands for a group of non-metallic atoms necessary for forming a carbon ring nucleus or heterocyclic ring nucleus, Y stands for a group capable of forming, on cleavage of the thioether linkage, a mercaptan type compound having development inhibiting activity together with the sulfur atom, and A stands for an oxygen atom or the group =NR in which R stands for a hydroxyl group or a amino group which may be substituted.

4. A multi-layer photosensitive material for color photography as defined in claim 3 wherein said mercaptan type development inhibitor-releasing compound comprises one or more compounds selected from the following:

2-(1-phenyl-5-tetrazolythio)cyclopentanone
2-(1-phenyl-5-tetrazolylthio)cyclohexanone
2,5-di(1-phenyl-5-tetrazolylthio)cyclopentanone
2-(2-benzoxazolylthio)cyclopentanone oxime
2-(1-phenyl-5-tetrazolylthio)-4-dodecyloxyindanone-(1)
2-(1-phenyl-5-tetrazolylthio)-6-[α-(2,4-di-tertamylphenoxy)acetamido] indanone-(1)
2-(1-phenyl-5-tetrazolythio)-7-tert-butylindanone-(1)
2-(1-phenyl-5-tetrazolylthio)-4-palmitoylamido-6-chloroindanone-(1)
2-(1-phenyl-5-tetrazolylthio)cyclobutanone oxime
2-(1-phenyl-5-tetrazolylthio)-5-tert-butylindanone-(1)-semicarbazone
2,5-di(1-phenyl-5-tetrazolylthio)-4-tert-octylcyclohexanone
2-(1-phenyl-5-tetrazolylthio)indanone-(1)
2-(1-phenyl-5-tetrazolylthio)-6-[α-(2,4-di-tert-amylphenoxy)acetamido] indanone-(1) oxime
2,5-di(1-phenyl-5-tetrazolylthio)cyclododecane
2-(2-benzoxazolylthio)-5-pentadecyloxycyclopentanone
2-(2-nitrophenylthio)-6-stearoyloxycyclohexanone
2-(1-phenyl-5-tetrazolylthio)-5-isoamyl-5′-phenylcyclopentanone
2-(1-phenyl-5-tetrazolylthio)-5-dodecylindanone-(1)
2-(1-phenyl-5-tetrazolylthio)-5-decylcyclopentanone
2-(2-carboxyphenylthio)-5-decylcyclopentanone
2-(1-phenyl-5-tetrazolylthio)-6-tert-butylindanone-(1)
2,5-di(1-phenyl-5-tetrazolylthio)-3-tert-octylcyclopentanone
2-(1-phenyl-5-tetrazolylthio)tetralone-(1)
2-(1-phenyl-5-tetrazolylthio)-4-methyl-7-dodecyloxyindanone-(1)
2-(1-phenyl-5-tetrazolylthio)-5-[α-(2,4-di-tertamylphenoxy)acetamido] indanone-(1)
2-(1-phenyl-5-tetrazolythio)-7-[α-(2,4-di-tertamylphenoxy)acetamido] indanone-(1)
1-n-dodecyl-3-(1-phenyl-5-tetrazolylthio)-4-piperidine
1-n-dodecyl-3,5-di(1-phenyl-5-tetrazolylthio)-4-piperidone oxime
2-(1-phenyl-5-tetrazolylthio)-4-(2,4-di-tert-amylphenoxyacetamido)-1-indanone
2-(1-phenyl-5-tetrazolylthio)-4-octadecyl succinimido-1-indanone

5. A multi-layer photosensitive material for color photography as defined in claim 1 wherein said first color image-forming layer unit contains at least one 2-and/or 4-equivalent color coupler which forms layer unit contains at least one 2-and/or 4-equivalent color coupler which forms a magenta dye image upon development and said third image-forming layer unit contains at least one 2-and/or 4-equivalent color coupler which forms a yellow dye image upon development.

6. A multi-layer photosensitive material for color photography as defined in claim 1, wherein said first image-forming layer unit contains one or more phenolic or α-naphtholic couplers capable of forming a cyan dye image upon development, said second image-forming layer unit comprises said upper layer containing one or more 5-pyrazolone couplers capable of forming a magenta dye image upon development and said lower layer containing one or more 5-pyrazolone couplers capable of forming a magenta dye image upon development and at lease one mercaptan type development inhibitor releasing compound, and said third layer contains one or more ketomethylene couplers capable of forming a yellow dye image upon development.

7. A multi-layer photosensitive material for color photography as defined in claim 6, wherein said cyan dye image forming couplers are 1-hydroxy-4-(2-ethoxycarbonylphenylazo)-N-[α-(2,4-di-tert-amylphenoxy)-butyl ]-2-naphthamide and 1-hydroxy-N-[α-(2,4-di-tert-amylphenoxy)butyl] -2-naphthamide, said magenta dye image forming couplers in said upper layer are 1-(2,4,6-trichlorophenyl)-3-{3-[-α-(2,4-di-tertamylphenoxyacetamido] benzamido }-4-(4′-methoxyphenylazo)-5-pyrazolone and 1-(2,4,6-trichlorophenyl)-3-{3-[α-(2,4-di-tert-amylphenoxy)acetamido]-benzamido}-5-pyrazolone, said magenta dye image forming coupler in said lower layer are 1-(2,4,6-trichlorophenyl)-3-{3-[α-(2,4,-di-tert-amylphenoxy)acetamido] anilino}-4-(methoxyphenylazo)-5-pyrazolone and 1-(2,4,6-tricholophenyl)-3-[3-(α-2,4-di-tert-amylpnenoxy)-acetamido] benzamido-5-pyrazolone and said mercaptan type development inhibitor-releasing compound in said lower layer is 2-(1-phenyl-5-tetrazolylthio)-6-[α-(2,4-di-tertamylphenoxy)acetamido] indanone-(1), and said yellow dye image forming coupler is α-(4-nitorphenoxy)-α-pivalyl-5-[α-(2,4-di-tert-amylphenoxy)-butyramido] -2-chloroacetanilide

8. A multi-layer photosensitive material for color photography as defined in claim 5, wherein said first color image forming layer unit comprises a upper layer and a lower layer, said upper layer and lower layer containing cyan couplers of 1-hydroxy-4-(2-ethoxycarbonylphenylazo)-N-[α-(2,4-di-tertamylphenoxy)butyl] -2-naphthamide 1-hydroxy-N-[α-(2,4-di-tert-amylphenoxy)butyl]-2-naphthamide and a mercaptan type development inhibitor releasing compound of 2-(1-phenyl-5-tetrazolythio)-4-dodecyloxyindanone-(1), said second image forming layer unit comprises an upper layer and a lower layer, said upper layer containing magenta dye image forming couplers of 1-(2,4,6-trichlorophenyl)-3-{3-[α-(2,4-di-tert-amylphenoxy)acetamido]anilino}-4-(methoxyphenylazo)-5-pyrazolone and 1-(2,4,6-trichlorophenyl)-3-[3-(α-2,4-di-tertamylphenoxy)-acetamido] benzamido-5-pyrazolone, said lower layer containing 1-(2,4,6-trichlorophenyl)-3-{3-[α-(2,4-di-tert-amylphenoxy)acetamido] anilino}-4-(methoxyphenylazo) -5-pyrazolone and 1-(2,4,6-trichlorophenyl)-3-[3-(α-2,4-di-tert-amylphenoxy)acetamido] benzamido-5-pyrazolone and a mercaptan type development inhibitor releasing type compound of 2,5-di(1-phenyl-5-tetrzolylthio)-4 -tert-octylcyclohexanone, and said third image forming layer unit contains a coupler of α-(4-nitorphenoxy)-α-pivalyl-5-[α-(2,4-di-tertamylphenoxy)butyramido] -2-chloroacetanilide.

9. A multi-layer photosensitive material for color photography as defined in claim 1, wherein said upper layer contains less than 3 mole % of coupler based on silver halide.

* * * * *